US008798487B2

(12) United States Patent
Asano et al.

(10) Patent No.: US 8,798,487 B2
(45) Date of Patent: Aug. 5, 2014

(54) IMAGE FORMING APPARATUS

(75) Inventors: Tomoharu Asano, Shizouka (JP); Takaaki Ikegami, Shizouka (JP); Michio Kimura, Shizouka (JP)

(73) Assignee: Ricoh Company, Ltd., Tokyo (JP)

( * ) Notice: Subject to any disclaimer, the term of this patent is extended or adjusted under 35 U.S.C. 154(b) by 268 days.

(21) Appl. No.: 13/348,062

(22) Filed: Jan. 11, 2012

(65) Prior Publication Data

US 2012/0183310 A1 Jul. 19, 2012

(30) Foreign Application Priority Data

Jan. 17, 2011 (JP) ..... 2011-006893

(51) Int. Cl.
*G03G 15/00* (2006.01)

(52) U.S. Cl.
USPC ..... 399/26

(58) Field of Classification Search
USPC ..... 399/26, 48, 128
See application file for complete search history.

(56) References Cited

U.S. PATENT DOCUMENTS

| | | | | |
|---|---|---|---|---|
| 6,415,122 | B1 * | 7/2002 | Hara et al. | 399/128 |
| 2006/0127107 | A1 * | 6/2006 | Kamisuwa et al. | 399/26 |
| 2008/0152391 | A1 * | 6/2008 | Bae et al. | 399/231 |
| 2009/0285586 | A1 * | 11/2009 | Kawaguchi | 399/12 |
| 2010/0129093 | A1 * | 5/2010 | Nakayama et al. | 399/31 |
| 2011/0170884 | A1 | 7/2011 | Yamane et al. | |
| 2011/0286777 | A1 | 11/2011 | Sugino et al. | |

FOREIGN PATENT DOCUMENTS

| | | |
|---|---|---|
| JP | 5-100517 | 4/1993 |
| JP | 2006-139272 | 6/2006 |
| JP | 2009-92709 | 4/2009 |
| JP | 2010-128012 | 6/2010 |

* cited by examiner

*Primary Examiner* — David Gray
*Assistant Examiner* — Thomas Giampaolo, II
(74) *Attorney, Agent, or Firm* — Cooper & Dunham LLP

(57) ABSTRACT

An image forming apparatus having an image bearing member, a charger to charge the surface of the image bearing member, an irradiator to irradiate the image bearing member to form the latent image, a developing device to develop the latent electrostatic image with toner to obtain a visible image, a transfer device to transfer the visible image to a transfer medium by a transfer bias applied to a transfer area between the image bearing member and the transfer member, and a voltage detector to measure a first surface voltage and a second surface voltage under different conditions, and a life expectancy identification device to identify whether or when the expected working life of the image bearing member has come to the end based on a comparison of the first surface voltage and the second surface voltage.

8 Claims, 6 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2011-006893, filed on Jan. 17, 2011 in the Japanese Patent Office, the entire disclosure of which is hereby incorporated by reference herein.

BACKGROUND OF THE INVENTION

1. Field of the Invention

The present invention relates to an image forming apparatus.

2. Description of the Background Art

In image forming apparatuses employing electrophotography, the surfaces of image bearing members installed in the apparatus are abraded by frictional sliding contact with a cleaning blade and developing agents and the photosensitive layer of the image bearing member is fatigued by repetitive charging and discharging, which results in deterioration of the image bearing member over time. The image bearing members that produce defective images beyond tolerance because of the deterioration over time are determined to have reached the end of their working life.

In general, image bearing members are replaced before the end of their working life. The time when image bearing members are replaced is typically set as follows: Preliminarily, a test machine having the same configuration as a target machine is subjected to an endurance test and used in a typical environment and under normal use conditions until the image bearing member has come to the end of its working life. In this test, the total number of output images, the total cumulative number of rotations, etc., of the image bearing member are obtained and used as life expectancy indices. With regard to the image bearing member installed in the target machine, the replacement timing of the image bearing member is set based not on individual image forming apparatuses but on the life expectancy indices.

However, exactly when the image bearing member has come to the end of its working life depends greatly on the environment and conditions of usage of individual image forming apparatuses. Therefore, if the replacement timing of the image bearing member is fixed, there is a risk that the image bearing member breaks down before the replacement timing. When the image bearing member has come to the end of its working life before its replacement timing, it is probable that defective images are output. In such a case, after replacing the image bearing members the defectively imaged item must be printed again.

It is possible to set the replacement timing of the image bearing member in any usage environment and condition early enough to avoid continuing printing with a defective image bearing member. However, as a result, a number of image bearing members are likely to be replaced prematurely, which is uneconomical and moreover wasteful.

Therefore, published Japanese patent application publication nos. 2009-92709 (JP-2009-92709-A) and JP-H05-100517-A describe determining whether an image bearing member has come to the end of its working life or predicting the life expectancy thereof based on readings of the image bearing member in use in each image forming apparatus. Thus, JP-2009-92709-A describes a device that detects the difference between the charging voltage of the first round and that of the second round after the start of charging of the image bearing member in rotation as a delay of charging that exceeds a predetermined allowance, and predicts when the image bearing member comes to the end of its working life based on the detection results.

JP-H05-100517-A describes a device that measures the surface voltage of a charged image bearing member twice at the same position, once before and once after a single rotation ($V_{SO}$ and $V_{S1}$), without irradiation of the image bearing member with light or application of a developing bias or a transfer bias, to obtain two voltage readings of the charge ($V_{SO}$ and $V_{S1}$), and predicts the life expectancy of the image bearing member from the difference between $V_{SO}$ and $V_{S1}$. In this image forming apparatus, the calculated comparison "$V_{SO}-V_{S1}$" is defined as the dark decay amount $V_{DD}$ of the image bearing member at this point in time of the target image bearing member, and the life expectancy of the image bearing member is predicted from a relation between a dark decay $V_{DD}S$ of a new image bearing member and a preset, predetermined dark decay limit amount $V_{DD}Limit$ In the image forming apparatus described in JP-2009-92709-A mentioned above, the life expectancy of the image bearing member is predicted based on detection of a charging delay, that is, the difference in the voltage at the surface of the image bearing member between the first rotation and the second rotation of the image bearing member after starting charging the image bearing member.

In theory, it is possible to be aware of the degree of charging delay at the detected portion on the surface of the image bearing member, i.e., how much the voltage at the surface of the image bearing member by the charging falls short of the target voltage for one rotation, from such a simple difference in the post-charging voltage between the first round and the second round. Therefore, according to the image forming apparatus described in JP-2009-92709-A mentioned above, the life expectancy of the image bearing member related to deterioration of the image quality caused by the charging delay can in theory be predicted.

However, in practice, the residual image is caused by the difference in the degree of the transfer impact on the image bearing member between the portion where no toner was attached and the portion where toner was attached. Therefore, it is not possible to be aware of the difference in the degree of the transfer impact from the simple difference in the post-charging voltage between the first round and the second round. Therefore, the image forming apparatus described in JP-2009-92709-A mentioned is not able to predict the life expectancy of the image bearing member ended by production of defective images with a residual image or determine whether the life of the image bearing member is over because of the production of such defective images.

The same is true in the case of the image forming apparatus described in JP-H05-100517-A mentioned above. That is, it is not possible to predict the life expectancy of the image bearing member ended by production of defective images with a residual image or determine whether the life of the image bearing member is over because of the production of such defective images.

SUMMARY OF THE INVENTION

In view of the foregoing, the present invention provides an improved image forming apparatus including an image bearing member to bear a latent electrostatic image, a charger to charge a surface of the image bearing member, an irradiator to irradiate the image bearing member with light to form the latent image, a developing device to develop the latent electrostatic image with a developing agent comprising toner to obtain a visible image, a transfer device to transfer the visible image to a transfer medium by a transfer bias applied to a transfer area between the image bearing member and the transfer member, a surface voltage detector to measure a first surface voltage of a surface portion of the image bearing member charged by the charger after the image bearing member has passed through the transfer area where the transfer bias is applied by the transfer device to satisfy a first set of current and/or voltage conditions and a second surface voltage of a surface portion of the image bearing member charged by the charger after the image bearing member has passed through the transfer area where the transfer bias is applied by the transfer device to satisfy a second set of current and/or voltage conditions different from the first set of current and/or voltage conditions in absolute value of a current or a voltage applied per unit of area of the surface of the image bearing member; and a life expectancy identification device to determine whether the image bearing member has come to the end of its working life based on a comparison of the first surface voltage and the second surface voltage measured by the surface voltage detector.

As another aspect of the present invention, an image bearing member to bear a latent electrostatic image, a charger to charge a surface of the image bearing member, an irradiator to irradiate the image bearing member with light to form the latent image, a developing device to develop the latent electrostatic image with a developing agent comprising toner to obtain a visible image, a transfer device to transfer the visible image to a transfer medium by a transfer bias applied to a transfer area between the image bearing member and the transfer member, a surface voltage detector to measure a first surface voltage of a surface portion of the image bearing member charged by the charger after the image bearing member has passed through the transfer area where the transfer bias is applied by the transfer device to satisfy a first set of current and/or voltage conditions and a second surface voltage of a surface portion of the image bearing member charged by the charger after the image bearing member has passed through the transfer area where the transfer bias is applied by the transfer device to satisfy a second set of current and/or voltage conditions different from the first set of current and/or voltage conditions in absolute value of a current or a voltage applied per unit of area of the surface of the image bearing member; and a life expectancy prediction device to predict when the image bearing member comes to the end of its working life based on a comparison of the first surface voltage with the second surface voltage.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
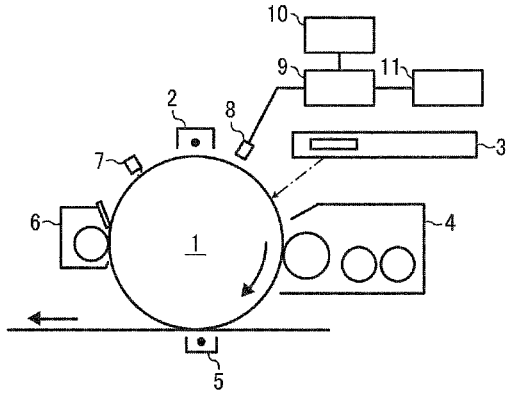
FIG. 1 is a schematic diagram illustrating the entire structure of the image forming apparatus related to a first embodiment described later.

Image bearing members have come to the end of its working life when defective images are output beyond a tolerance because of the degradation of the image bearing member caused by abrasion of the surface thereof, the fatigue of the photosensitive layer, etc. There are different kinds of degradation of image quality by which image bearing members are determined as their end of life.

One of them is a residual image reflecting the contrasting density of the previously formed image. In the residual images, there are positive residual images and negative residual images. In the positive residual images, the image density of the (toner attached) portion of the surface of an image bearing member to which toner is attached at the time of forming the previous image is thicker than that of the (toner non-attached) portion of the surface of an image bearing member to which toner is not attached at the time of forming the previous image. In the negative residual image, this image density configuration is reversed.

Both residual images are mainly caused by a transfer current or a transfer voltage applied to the surface of the image bearing member when a toner image on the image bearing member is transferred to a transfer medium (recording medium, intermediate transfer medium, etc.).

In detail, a transfer current or a transfer voltage is directly applied to the toner non-attached portion of the image bearing member by a transfer member. By contrast, a transfer current or a transfer voltage is indirectly applied to the toner attached portion of the image bearing member by a transfer member because toner is present between the image bearing member and the transfer member. Due to this difference, the toner non-attached portion is easily affected by the transfer current and transfer voltage in comparison with the toner attached portion.

Unless a degraded image bearing member is used, irrespective of the difference in the degree of the impacts of the transfer current and the transfer voltage (hereinafter referred to as transfer impact) between the portion where toner is attached and the portion where no toner is attached, both portions are suitably charged up to a target voltage by charging in combination with discharging before the charging on the necessity basis in the next image formation. However, if a degraded image bearing member is charged at these portions in the same manner (including discharging before charging on the necessity basis), the voltage after charging at the portion where no toner was attached the last time is insufficient relative to the portion where toner was attached since the transfer impact is relatively large on the portion where no toner was attached in comparison with the portion where toner was attached.

As a result, after charging in the image forming process this time, the absolute voltage at the portion where no toner was attached the last time is smaller than that at the portion where toner was attached the last time. Therefore, the surface of the image bearing member is not uniformly charged, thereby creating a difference in the developing potential. Consequently, the amount of attached toner is different between the portion where toner was attached the last time and the portion where no toner was attached the last time. Therefore, in the image produced by the image forming process this time, the density at the portion where no toner was attached the last time is relatively thick. This contrasting density causes a residual image reflecting the image produced the last time. This residual image is conspicuous when a half tone image is formed.

With regard to typical image forming apparatuses, determining whether the life of an image bearing member has come to the end or predicting when the life of an image bearing member has come to the end is left undone about production of defective images with such a residual image.

Residual images are caused by the difference in the degree of transfer impact (i.e., impact of the transfer current and the transfer voltage) on an image bearing member between a portion where no toner is attached and a portion where toner is attached. As the difference in the degree increases, the difference in the post-charging surface voltage of the image bearing member increases between the portion where no toner is attached and the portion where toner is attached. The larger the difference of the post-charging surface voltage, the larger the contrasting density (difference in the image density). Accordingly, the image quality deteriorates due to the residual image.

In the present invention, to become aware of the difference in the degree of transfer impact on an image bearing member between the portion where no toner is attached and the portion where toner is attached, the post-charging surface voltages of the image bearing member that has passed the transfer area in which a bias is applied according to a first set of current and/or voltage conditions or a second set of current and/or voltage conditions are compared. The currents and the voltages applied per unit of area to the surface of the image bearing member while the image bearing member passes through the transfer area are different between both conditions. The comparisons include, for example, the difference and the ratio between the post-charging surface voltages in the first set of current and/or voltage conditions and the second set of current and/or voltage condition. The comparisons of the post-charging surface voltages obtained by changing the conditions in such a way are correlative with the difference in the post-charging surface voltages between the portion where no toner is attached and the portion where toner is attached, and are used as an index indicating the degree of the degradation of the image quality related to residual images.

In the present invention, since the life of the image bearing member is identified based on the comparisons, the end of the life or the life expectancy of the image bearing member can be suitably identified about the residual image.

First Embodiment

An embodiment (hereinafter referred to as first embodiment) of the present disclosure is described below.

FIG. 1 is a schematic diagram illustrating the entire structure of the image forming apparatus related to the first embodiment.

The image forming apparatus has an image bearing member 1 having a drum form that rotates in the direction indicated by an arrow. Around the image bearing member 1, there are provided a charger 2 to charge the surface of the image bearing member 1, an irradiator 3 serving as a latent electrostatic image forming device that irradiates the surface of the charged image bearing member 1 with a laser beam L to form a latent electrostatic image thereon, a development device 4 that develops the latent electrostatic image with a developing agent containing toner to obtain a visible (toner) image, a transfer device 5 that transfers the visible image to a transfer medium (recording medium), typically paper, a cleaner 6 serving as a cleaning device that removes toner remaining on the surface of the image bearing member 1 after transferring, and a discharging device 7 that removes residual charges on the surface of the image bearing member 1 along the rotation direction of the image bearing member in this sequence. In addition, a voltage detector 8 to measure the (first and second) surface voltages of the image bearing member 1 is arranged downstream from the charging area where the image bearing member 1 is charged by the charger 2 and upstream from the writing area where the image bearing member 1 is irradiated with light relative to the rotation direction of the image bearing member 1. The voltage detector 8 serves as a surface voltage detector in the first embodiment. The voltage detector 8 can be separately provided to detect the first surface voltage and the second surface voltage. Additionally, the image forming apparatus has a life expectancy identification unit 9, a recording memory 10 serving as an over-time information memory device, and a notification unit 11 serving as a determination result notifying device, a prediction result notifying device, and an exchanging notification device.

When images are formed by the image forming apparatus, original image signals read from an original at the image reader or original image signals made by a computer outside, etc. are input into the image processing unit for the following suitable image processing. The thus-obtained input image signals are input into the irradiator 3 to modulate laser beams. The surface of the image bearing member 1 charged by the charger 2 is irradiated with the laser beam L modulated based on the input image signals. Upon irradiation of the laser beams on the surface of the image bearing member 1, a latent electrostatic image corresponding to the input image signals is formed on the image bearing member 1.

The latent electrostatic image formed on the image bearing member 1 is developed with toner by the development device 4 to form a toner image on the image bearing member 1. The toner image formed on the image bearing member 1 is conveyed along with the rotation direction of the image bearing member 1 indicated by an arrow in FIG. 1 to the transfer device 5 arranged facing the image bearing member 1. On the other hand, a transfer paper is fed from a paper feeder to the transfer area between the image bearing member 1 and the transfer device 5 and the toner image on the image bearing member 1 is transferred to the transfer paper by a transfer bias applied to the transfer area by the transfer device 5. The transfer paper on which the toner image is transferred is conveyed to a fixing device where the toner image is fixed upon application of heat and pressure and discharged outside the image forming apparatus.

The material such as toner still attached to the surface of the image bearing member 1 after transfer of the toner image to the transfer paper is removed by the cleaner 6. Furthermore, the residual charge on the surface of the image bearing member 1 is also removed by the discharging device 7 to complete a cycle of image formation.

While this image formation is repeated tens of thousands of or millions of times, the image bearing member 1 is degraded by various kinds of damage. When the image bearing member is degraded, the (history) image formed the last time remains on the image bearing member as a result of uneven surface voltage described above, which may lead to contrasting density, i.e., residual image, on the following image. The residual image is greatly affected by toner remaining on the image bearing member after transfer. In other words, the difference in the degree of transfer impact on the image bearing member relates to occurrence of the residual image.

Figure 2:
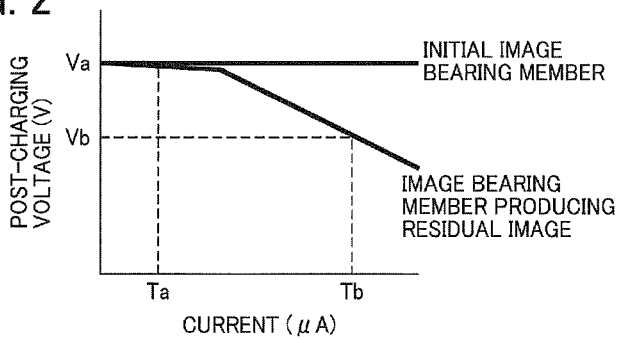
FIG. 2 is a graph illustrating the locus of the post-charging surface voltages at the surface portion of an initial (i.e., unused and fresh) image bearing member and an image bearing member producing residual images while changing the amount of the current flowing on the surface portion by changing the bias applied from a transfer device.

FIG. 2 is a graph illustrating the locus of the post-charging surface voltages at the surface portion of an initial (i.e., unused and fresh) image bearing member and an image bearing member producing residual images for the surface portion thereof where the current flows while changing the amount of the current flowing on the surface portion by changing the bias applied from the transfer device 5. The linear speed during the rotation of the image bearing members and the length thereof along their axes of both image bearing members are the same. There is no change in the post-charging surface voltages with regard to the initial image bearing member even when the transfer current changes. By contrast, with regard to the used-up image bearing member producing residual images, as the transfer current flowing therein changes, the post-charging surface voltage of the image bearing member after charging of the surface portion where the transfer current has flown greatly changes. To be specific, if a transfer current increases to some extent, the post-charging surface voltage becomes insufficient. Such changes in the post-charging surface voltage is inferred to be caused by the same mechanism as the uneven post-charging surface voltages based on the difference in the degree of the transfer impact between the portion where toner is attached and the portion where no toner is attached on the image bearing member.

In the first embodiment, two (first and second) conditions are set which have different currents applied to unit of area of the surface of the image bearing member while the image bearing member passes through the transfer area. The post-charging surface voltages of the image bearing member that has passed through the transfer area to which a bias is applied to satisfy the first set of current and/or voltage conditions is measured by the voltage detector 8 and referred to as the first post-charging voltage Va.

The post-charging surface voltages of the image bearing member that has passed through the transfer area to which a bias is applied to satisfy the second set of current and/or voltage conditions is measured by the voltage detector 8 and referred to as the second post-charging voltage Vb. Thereafter, the absolute difference value (comparison) ΔV between Va and Vb is obtained and set as an index value indicating the difference in the post-charging surface voltage between the portion where toner was attached the last time and the portion where no toner was attached the last time (i.e., an index value indicating the degree of degradation of image quality by a residual image).

That is, based on this difference value ΔV, the end of life or the life expectancy of an image bearing member is identified.

In the first embodiment, the first post-charging voltage Va is the post-charging surface voltage of the image bearing member 1 that have passed through the transfer area to satisfy the first set of current and/or voltage conditions when the cumulative number of rotations of the image bearing member 1 is "n", and the second post-charging voltage Vb is the post-charging surface voltage of the image bearing member 1 that have passed through the transfer area to satisfy the second set of current and/or voltage conditions when the cumulative number of rotations of the image bearing member 1 is "n+1". In the first embodiment, the information indicating the relation between the cumulative number of rotations of the image bearing member 1 and the standard difference value ΔV is recorded in the recording memory 10. This information is over-time information that consists of changes over time of the standard difference value ΔV of the image bearing member 1 under a predetermined environment until the image bearing member has come to an end of life. The life expectancy identification unit 9 obtains the first post-charging voltage Va measured under the first set of current and/or voltage conditions when the cumulative number of rotations of the image bearing member 1 is "n" and the second post-charging voltage Vb measured under the second set of current and/or voltage conditions when the cumulative number of rotations of the image bearing member 1 is "n+1" and calculates the difference value ΔV to compare it with a life determination reference value d. By this comparison, when the difference value ΔV is equal to or greater than the life determination reference value d, the image bearing member 1 is determined as end of life. In addition, when the difference value ΔV is less than the life determination reference value d, the life expectancy identification unit 9 refers to the over-time information on the recording memory 10 and predicts the life expectancy of the image bearing member 1 from the difference value ΔV and the over-time information.

In the first embodiment, the difference in the degree of the transfer impact on the image bearing member 1, which causes occurrence of residual images, greatly depends on the transfer current flowing on the image bearing member 1, the length of the image bearing member 1 along the axis direction thereof, and the linear speed of the image bearing member 1. The two conditions in the first embodiment are two set values A and B ($\mu A \cdot s/mm_2$) obtained by dividing the current (μA) flowing on the surface of the image bearing member 1 when the image bearing member 1 passes through the transfer area with the length (mm) of the image bearing member 1 along the axis direction and the linear speed (mm/s) of the image bearing member 1 under the conditions that the currents (μA) flowing on the surface of the image bearing member 1 are Ta and Tb, respectively, while not changing the length of the image bearing member 1 and the linear speed of the image bearing member 1.

The conditions of the charging treatment by the charger 2 when measuring the first post-charging voltage Va and the second post-charging voltage Vb can be arbitrarily set. That is, the conditions of the charging treatment can be changed from those during image formation. To be specific, for example, a method can be employed which includes preliminarily obtaining the conditions under which the surface voltage of the image bearing member 1 is −600 V by the charging treatment of the surface portion of the image bearing member 1 that has passed through the transfer area with no application of a bias thereto when the cumulative number of rotations of the image bearing member 1 is zero and conducting measuring under the conditions. Another method can be employed which includes preliminarily obtaining the conditions under which the surface voltage of the image bearing member 1 is −600 V by the charging treatment of the surface portion of the image bearing member 1 that has passed through the transfer area with no application of a bias thereto every time and conducting the charging treatment under the conditions before the first post-charging voltage Va and the second post-charging voltage Vb are measured.

In the first embodiment, the second post-charging voltage Vb is measured when the cumulative number of rotations of the image bearing member is "n+1", which is the next rotation of the image bearing member 1 after measuring the first post-charging voltage Va when the cumulative number of rotations of the image bearing member 1 is "n". Therefore, the second post-charging voltage Vb is the post-charging surface voltage of the image bearing member 1 that has passed through the transfer area to satisfy the second set of current and/or voltage conditions while the surface portion of the image bearing member 1 charged to the first post-charging voltage Va is not charged or discharged. Therefore, the second post-charging voltage Vb is affected by the first post-charging voltage Va. Therefore, it is preferable to set the set values A and B of the conditions in such a manner that the current Ta of the first post-charging voltage Va is less than the current Tb of the second post-charging voltage Vb. As the current at measuring decreases, the shortage of the post-charging surface voltage decreases. Therefore, by making the current Ta under the first set of current and/or voltage conditions is less than the current Tb under the second set of current and/or voltage condition, the impact of the first post-charging voltage Va on the second post-charging voltage Vb can be reduced.

In addition, the degree of the transfer impact on the image bearing member 1 greatly relates to not only the transfer current and the transfer voltage applied to the image bearing member but also the length of the image bearing member along its axis direction as described above and the linear speed thereof That is, when the transfer current and the transfer voltage are the same, the transfer impact is less on an image bearing member having a longer length along its axis direction and an image bearing member rotating at a higher linear speed. Therefore, in the first embodiment, the set values for each condition are defined as described above: (the current (μA) flowing on the surface of the image bearing member 1 when the image bearing member 1 passes through the transfer area)/(the length (mm) of the image bearing member 1 along the axis direction)/(the linear speed (mm/s) of the image bearing member 1). In the first embodiment, when the absolute difference value |A−B| between the set value A of the first set of current and/or voltage conditions and the set value B of the second set of current and/or voltage conditions is equal to or greater than $1.0\times10^{-5}$ ($\mu A\cdot s/mm^2$), a sufficient difference is created about the post-charging surface voltages between the initial image bearing member and the image bearing member that has come to an end of life. Therefore, in the first embodiment, the set values A and B are defined in such a manner that the absolute difference value |A−B| of the set values of each condition is equal to or greater than $1.0\times10^{-5}$ ($\mu A\cdot s/mm^2$).

In addition, to determine the end of life or predict the life expectancy of the image bearing member 1, measuring can be conducted at any timing but preferably before starting a printing job. When measuring to determine the end of life or predict the life expectancy of the image bearing member 1 is conducted between printing jobs or after a printing job, the degree of degradation of the image bearing member 1 accumulated for that period of time depends on the content of the printing job before measuring, which affects the measuring result.

In the first embodiment, the notification unit 11 having a control panel, etc. notifies a user (operator) or a field engineer of the results of the determination of the end of life or the prediction of the life expectancy of the image bearing member 1 by the life expectancy identification unit 9. Therefore, the user or the field engineer can replace the image bearing member on a suitable timing based on the information provided by the notification unit 11. Furthermore, the user or the field engineer can preliminarily make an order arrangement of image bearing members before the life of the image bearing member comes to an end because he/she is aware of the prediction result about the life expectancy thereof In addition, if the user cannot replace the image bearing member, the field engineer efficiently makes a visiting appointment because the field engineer is notified of the prediction results. Therefore, the down time of the image forming apparatus is reduced, thereby contributing to the improvement of the productivity.

Next, the determination of the end of life and the prediction of the life expectancy of the image bearing member 1 are described.

Figure 4:
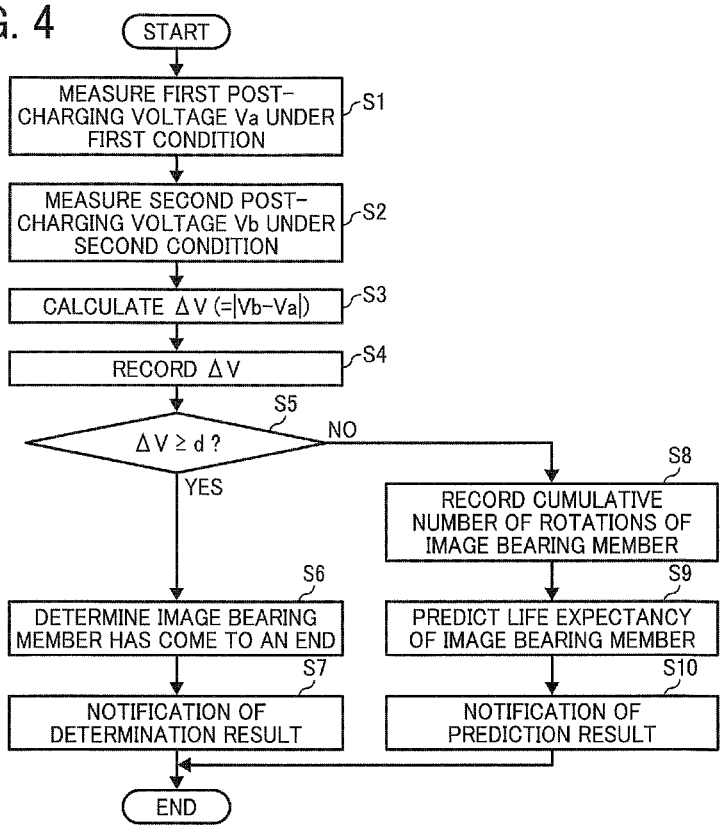
FIG. 4 is a flowchart illustrating steps in a process of the determination and prediction of life of an image bearing member of the first embodiment described below.

FIG. 4 is a flowchart illustrating steps in a process of the determination of life and the prediction of life expectancy of the image bearing member 1 of the first embodiment. As illustrated in FIG. 4, when the cumulative number of rotations of the image bearing member 1 is "n", the surface portion of the image bearing member 1 that has passed through the transfer area while satisfying the first set of current and/or voltage condition, i.e. the set value A, (that is, the current flowing on the surface is Ta when the image bearing member 1 passes through the transfer area) is charged by the charger 2 under a predetermined condition and then the surface voltage (the first post-charging voltage) Va of the image bearing member is measured (S1).

Next, when the cumulative number of rotations of the image bearing member 1 is "n+1", the surface portion of the image bearing member 1 that has passed through the transfer area while satisfying the second set of current and/or voltage condition, i.e. the set value B, (that is, the current flowing on the surface is Tb when the image bearing member 1 passes through the transfer area) is charged by the charger 2 under a predetermined condition and then the surface voltage (the second post-charging voltage) Vb of the image bearing member is measured (S2). From the measured values Va and Vb, the difference value ΔV (=|Vb−Va|) is calculated (S3) and recorded in recording memory 10 (S4).

Next, the difference value ΔV and the preliminarily set life determination reference value d are compared to determine whether ΔV is equal to or greater than d (S5). When ΔV is equal to or greater than d, the life of the image bearing member is determined to have come to an end (S6) and the notification unit 11 provides notification indicating that the image bearing member 1 has come to the end of its working life (S7). Depending on the set values A and B and the sensitivity of the voltage detector 8, the life determination reference value d is preferably 10 V or greater. The difference of the image density representing the residual images tends to increase in proportion to the difference of the post-charging surface voltage of the surface of the image bearing member 1. A small difference of the post-charging surface, for example, less than 10 V, does not cause a problem but the residual image problem is not ignorable when the difference is large. For example, when the life determination reference value d is set to be 20 V and ΔV is 30 V, ΔV is greater than d and therefore the image bearing member 1 is determined as the end of life.

Figure 3:
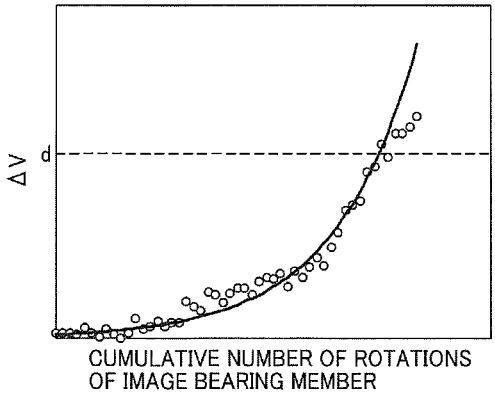
FIG. 3 is a graph illustrating a relation between the cumulative number of rotations of an image bearing member and the difference value (standard difference value) under normal usage environment and conditions.

On the other hand, when the ΔV is smaller than d in the step S5, the cumulative number n of rotation of the image bearing member when Va is measured is recorded (S8). Referring to the information (i.e., over-time information of the standard difference value ΔV until the image bearing member 1 has come to an end of life) indicating the relation between the cumulative number of rotations of the image bearing member and the standard difference value ΔV recorded in the recording memory 10 as illustrated in FIG. 3, the cumulative number of rotations of the image bearing member at when ΔV is equal to d is calculated, the calculated cumulative number of rotations is a prediction value for the end of life of the image bearing member 1 (S9).

Then, from the calculated cumulative number of rotations at the end of life and the cumulative number n of rotation of the image bearing member recorded in the step S8, the life expectancy of the image bearing member 1 is determined and the notification unit 11 notifies a user or a field engineer of the prediction results (S10).

Although the difference value ΔV tends to rise as the degradation of the image bearing member 1 advances, the difference value ΔV does not necessarily increase at a fixed rate against an increase of the cumulative number of rotations of the image bearing member 1. For example, as in the first embodiment illustrated in FIG. 3, the difference value ΔV has a tendency of exponential increasing to the cumulative number of rotations of the image bearing member in some cases. Therefore, at the development stage of image forming apparatuses, it is preferable to check the over-time information on the standard difference value ΔV indicating the behavior of the difference value ΔV to increases of the cumulative number of rotations of the image bearing member until the image bearing member has come to the end of its working life before determination of the life or prediction of life expectancy of the image bearing member in terms of correctness of the determination and prediction.

To be specific, for example, from the transition of the difference value ΔV detected in the past, the slope of the difference value ΔV against the cumulative number of rotations of the image bearing member is calculated. By comparing the calculation results with the extrapolation prediction using the over-time information in the recording memory 10 illustrated in FIG. 3 from the present time, the slope data of the difference value ΔV against the cumulative number of rotations of the image bearing member preliminarily obtained, and the preliminarily set value d, the life expectancy of the image bearing member, meaning that how many images can be printed before the end of its life, can be determined.

Figure 5:
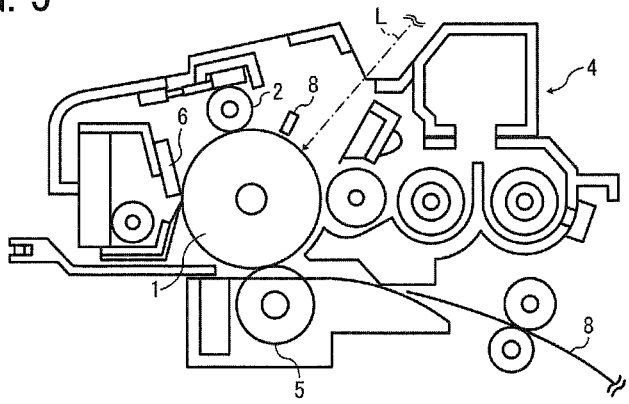
FIG. 5 is a schematic diagram illustrating an example of the process cartridge.
Figure 6:
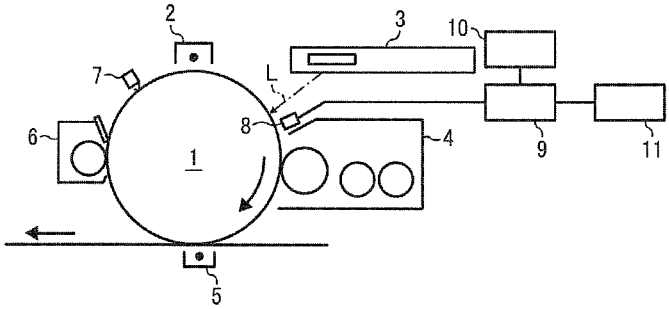
FIG. 6 is a schematic diagram illustrating an example in which a voltage detector 8 is provided downstream from the writing area and upstream from the development area relative to the rotation direction of the image bearing member.

The life expectancy identification unit 9 of the first embodiment is installed onto an image forming apparatus or a process cartridge contained therein. FIG. 5 is a diagram illustrating an example of the process cartridge. The process cartridge includes the image bearing member 1 and at least one of the charger 2, the development device 4, the transfer device 5, the cleaner 6, and a discharger, and the voltage detector 8, which are commonly supported by a supporting member. The process cartridge is a device (part) detachably attachable to the image forming apparatus.

In the first embodiment, as illustrated in FIG. 1, the voltage detector 8 is provided downstream from the transfer area and upstream from the writing area relative to the rotation direction of the image bearing member 1. The voltage detector 8 can be arranged downstream from the writing area and upstream from the development area where development process is conducted by the development device 4 relative to the rotation direction of the image bearing member 1.

Second Embodiment

Next, another (second) embodiment of the present invention is described.

Figure 7:
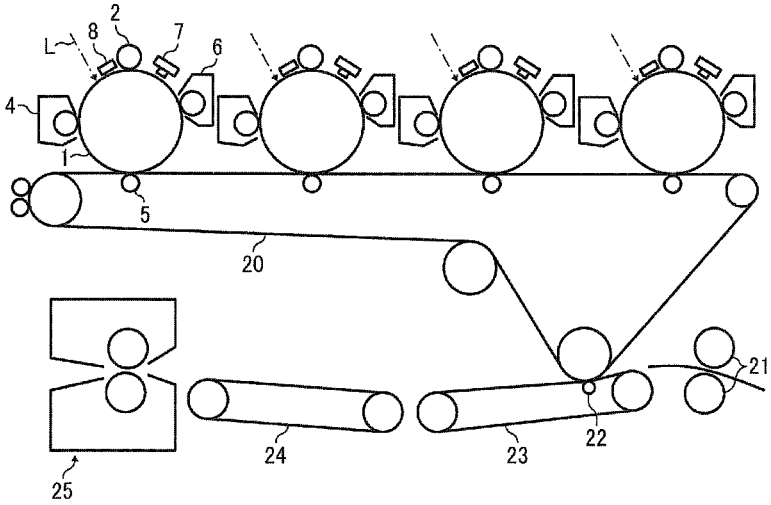
FIG. 7 is a diagram illustrating an example of a tandem-type color image forming apparatus related to a second embodiment described below.
Figure 8:
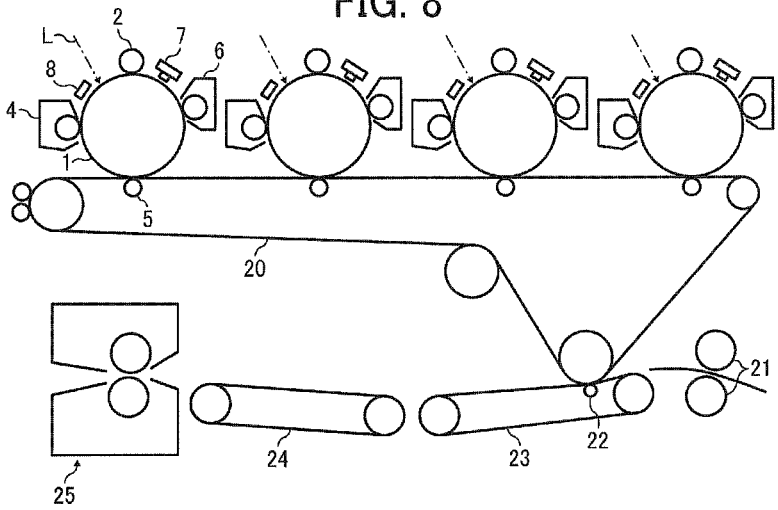
FIG. 8 is a diagram illustrating another example of a tandem-type color image forming apparatus related to the second embodiment described below.

The image forming apparatus related to the first embodiment is a monochrome image forming apparatus having a single image bearing member. The present invention can be applied to an image forming apparatus having multiple image bearing members, a so-called a tandem-type color image forming apparatus. FIGS. 7 and 8 are schematic diagrams illustrating examples of the tandem-type color image forming apparatus related to the second embodiment. The tandem-type color image forming apparatuses illustrated in FIGS. 7 and 8 form respective color toner images on the respective image bearing member using different color toner and primarily transfer and overlap these toner images on an intermediate transfer belt 20 serving as an intermediate transfer body. Then, the overlapping respective color toner images on the intermediate transfer belt 20 are secondarily transferred to a transfer paper fed from a pair of registration rollers 21 at the secondary transfer area facing a secondary transfer roller 22. The transfer paper on which the color toner image is secondarily transferred is conveyed to a fixing device 25 while borne on the surface of a transfer belt 23 and a conveyor belt 24 and the toner image is fixed by the fixing device 25 upon application of heat and pressure. The tandem-type color image forming apparatuses illustrated in FIGS. 7 and 8 have the same configuration except for the arrangement of the voltage detector 8.

The image bearing member 1 is separately provided for each color in the tandem-type color image forming apparatus. In general, the usage of consumption of toner is different among respective color toners depending on output images. Therefore, as a result of repeated image formation in such a circumstance, the deterioration speed among respective image bearing members 1 becomes different.

If the deterioration speed among the image bearing members s is different, when the image bearing members s have come to an end of life, i.e., the timing of the replacement thereof is also different. Therefore, the life or the life expectancy of the image bearing members 1 must be independently determined. It is possible to replace the image bearing members 1 every time the timing of replacement of the image bearing member 1 has come for each color. In this case, the frequency of the replacement of the image bearing members 1 for the entire image forming apparatus is high, which is heavy burden on users or field engineers. In the second embodiment, by having the following configuration, all the image bearing members 1 can be replaced at once.

Figure 9:
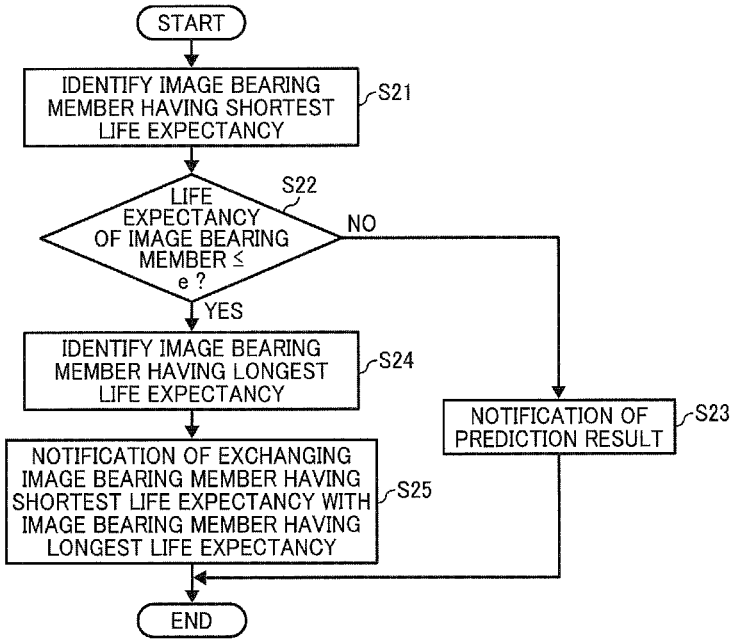
FIG. 9 is a flowchart illustrating a flow of determination process on exchanging of the image bearing member in the second embodiment described below.

FIG. 9 is a flowchart illustrating a flow of the determination process on replacement of the image bearing member in the second embodiment. In the second embodiment, the processes of determination of life and prediction of life expectancy illustrated in FIG. 4 of the first embodiment are the same for the respective four image bearing members 1. In the step S5, when the difference value ΔV is equal to or greater than the life determination reference value d in the comparison thereof about the four image bearing members 1, the step of replacing image bearing members 1 illustrated in FIG. 9 is used instead of the step S10 in which the prediction results for each image bearing member 1 in the life determination process and the life expectancy prediction process are provided.

In the step of replacing the image bearing members 1, the image bearing member 1 having the shortest life expectancy is identified (S21) based on the life expectancy for each image bearing member 1 determined from the prediction about when the life of the image bearing member 1 has come to an end in the step S9 in the life determination and life expectancy prediction processes illustrated in FIG. 4. By comparing the life expectancy of the identified image bearing member with a particular value e which is set to be shorter than the life expectancy, whether the life expectancy of the image bearing member is equal to or shorter than the particular value e is determined (S22). In this determination, when the life expectancy of the image bearing member is longer than the particular value e, the determination result of the image bearing member 1 having the shortest life expectancy is provided to a user or a field engineer by the notification unit 11 (S23) as in the step S10 in the life determination and the life expectancy prediction process illustrated in FIG. 4. Also, it is possible to notify a user or a field engineer of the determination result for each image bearing member 1.

On the other hand, in the step S22, when the life expectancy of the image bearing member having the shortest life expectancy is determined to be shorter than the particular value e, the image bearing member having the longest life expectancy is identified based on the life expectancy for each image bearing member (S24). The notification unit 11 provides a user or a field engineer with a notification of exchanging the image bearing member having the shortest life expectancy identified in the step S21 with the image bearing member having the longest life expectancy identified in the step S24 (S25). It is possible to provide this notification only when the difference of the life expectancy between the image bearing member having the shortest life expectancy and the image bearing member having the longest life expectancy is equal to or longer than a preliminarily-set value.

In the second embodiment, by determining the life expectancy of each image bearing member 1 after a certain period of time of use in an actual environment under actual conditions, the user or the field engineer can be aware of relative deterioration speed of image bearing members for each color in the actual environment under the actual conditions. In the second embodiment, until the life expectancy of the image bearing member 1 having the shortest life expectancy is equal to or greater than a particular e, a notification of exchanging the image bearing member 1 having the shortest life expectancy with the image bearing member 1 having the longest life expectancy is provided on a predetermined timing. In response to the notification, the user or the field engineer exchanges the image bearing member 1 having the shortest life expectancy with the image bearing member 1 having the longest life expectancy so that the image bearing member 1 having the longest life expectancy is used for color for which the degradation speed is the fastest and the image bearing member 1 having the shortest life expectancy is used for color for which the degradation speed is the slowest. As a result, in the course of using the image bearing members 1 for a certain period of time after the exchange, the difference in the life expectancy between the image bearing member 1 having the shortest life expectancy with the image bearing member 1 having the longest life expectancy becomes small. Therefore, the timing of the end of life of all of the image bearing members 1 is closer to each other than when such an exchange is not done. Therefore, all the image bearing members can be replaced at once while avoiding replacing the image bearing members with a long life expectancy left.

In particular, by repeating the determination process of exchanging the image bearing members, the life of all of the image bearing members 1 can be adjusted to expire almost at the same time, meaning that all the image bearing members 1 can be used without waste and replaced at once.

Variation

Next, one variation for the first embodiment and the second embodiment is described.

Image bearing members for use in image forming apparatuses are damaged and degraded during repeated image formation as described above. In addition, the image bearing member 1 is damaged by, for example, sharp change in the environment (temperature, humidity) and attachment of corona products remaining in the apparatus other than image formation. Due to such damage, the deterioration state of the image bearing member 1 is deviated greatly from the transition of the degradation of the image bearing member 1 and abruptly advances in some cases.

However, such abrupt deterioration of the image bearing member 1 can be restored by image formation or refresh operation, for example, abrasive sliding by a cleaning blade with the surface of the image bearing member 1. Therefore, when the life determination and the life expectancy prediction is conducted using the difference value ΔV obtained based on the measuring of the image bearing member 1 when accidental abrupt deterioration occurs to the image bearing member 1, the image bearing with a life expectancy left is determined to be dead or the difference between the predicted life expectancy and the actual one is large. The variation makes it possible to provide an accurate life determination and life expectancy prediction even when such accidental abrupt deterioration occurs to the image bearing member 1.

Figure 10:
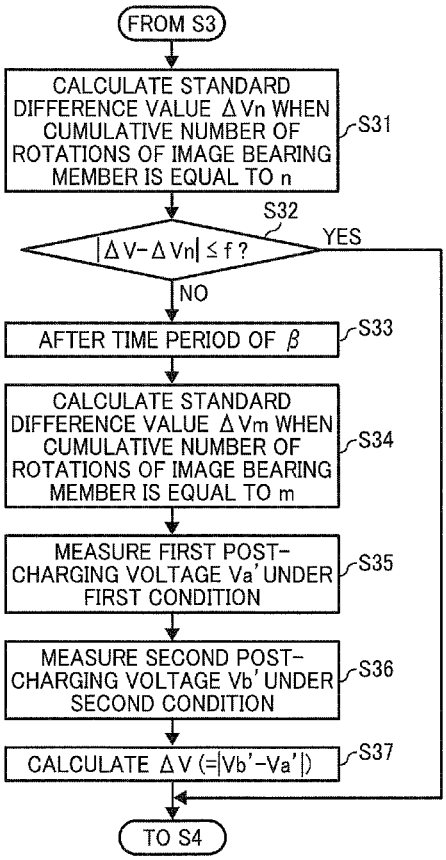
FIG. 10 is a flowchart illustrating an additional process related to a variation described below which are inserted between the step S3 and the step S4 in the processes of the determination and prediction of life of an image bearing member illustrated in FIG. 4.

FIG. 10 is a flowchart showing additional processes inserted between the step S3 and the step S4 of the life determination and the life expectation prediction illustrated in FIG. 4.

Once the difference value ΔV is calculated in the step S3 in the life determination and the life expectation prediction illustrated in FIG. 4, the standard difference value ΔVn corresponding to the cumulative number of rotations n this time is calculated from the over-time information (locus of the standard difference value ΔV against the cumulative number of rotation) on the recording memory 10 illustrated in FIG. 3 (S31). The difference between the difference value ΔV and the standard difference value ΔVn is calculated and the calculation result and a pre-set value f are compared (S32). In this comparison, when $|\Delta V-\Delta Vn|$ is equal to or less than the pre-set value f, proceed to the step S4 and the difference value ΔV calculated in the step S3 is recorded in the recording memory 10 followed by the life determination and the life expectancy prediction based on the difference value ΔV.

Figure 11:
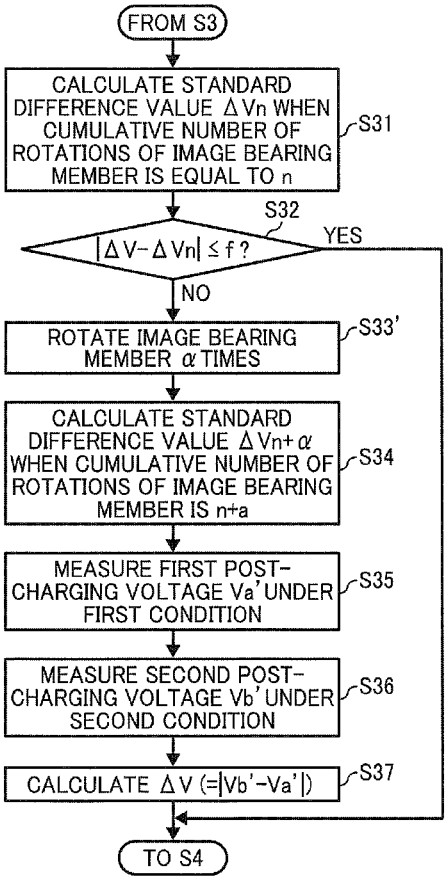
FIG. 11 is a flowchart illustrating another additional process related to the variation described below which are inserted between the step S3 and the step S4 in the processes of the determination and prediction of life of an image bearing member illustrated in FIG. 4.

By contrast, in the comparison, when $|\Delta V-\Delta Vn|$ is greater than the pre-set value f, after the time period of β (S33) the standard difference value ΔVm which corresponds to a cumulative number of rotations m (=n+α) obtained by adding the number of rotation a of the image bearing member 1 for the time period of β to the cumulative number of rotations n measured the last time is calculated (S34) from the over-time information in the recording memory 10 illustrated in FIG. 3. This is the case in which the standard difference value ΔVm is calculated after the time period of β. It is also possible to calculate the standard difference value ΔVm after the image bearing member rotates a rounds as illustrated in FIG. 11.

After the standard difference value ΔVm is calculated, the first post-charging voltage Va' is measured to satisfy the first set of current and/or voltage conditions (set value A) when the cumulative number of rotations of the image bearing member is m (S35). Next, when the cumulative number of rotations of the image bearing member is m+1, the second post-charging voltage Vb' is measured to satisfy the first set of current and/or voltage conditions (set value A) when the cumulative number of rotations of the image bearing member is m+1 (S36). From the measured values Va' and Vb', the difference value ΔV (=|Vb'−Va'|) is calculated (S37) and recorded in recording memory 10 (S4) In the process thereafter, the life determination and the life expectancy prediction are conducted using the difference value ΔV calculated in the step 37.

With regard to the cumulative number of rotations n and the cumulative number of rotations m, n is a natural number and m is a natural number which is n+2 or greater. α is also a natural number.

The time period of β is equal to or longer than a time required to restore temporary deterioration of the image bearing member and the rotation number α is the rotation number of the image bearing member required to restore the temporary deterioration. These values α and β are flexibly set depending on the temporary deterioration, which may be restored in a short (several rounds of rotation) or long period of time.

If it takes a long time to restore the image bearing member from the temporary deterioration, for example, the image bearing member can be subjected to refreshing treatment such as heating and forcible abrasion of the surface of the image bearing member by rotating the image bearing member while supplying toner to the surface of the image bearing member. When the calculated difference between the difference value ΔV and the standard difference value ΔVn is large, the result is optionally provided to the user and/or the field engineer by the notification unit 11.

The image forming apparatus described in the first and the second embodiments (including the variation) charges the surface of the rotary image bearing member 1 by the charger 2 serving as the charging device to form a latent electrostatic image on the surface of the charged image bearing member 1, develops the latent electrostatic image by the development device 4 to obtain a toner image, and transfers the toner image from the image bearing member 1 to a transfer material by a transfer bias applied to the transfer area between the image bearing member 1 and the transfer material (transfer paper as a recording medium or the intermediate transfer belt 20) by the transfer device 5.

The image forming apparatus has the voltage detector 8 serving as the surface voltage detector. The voltage detector 8 measures the first surface voltage (the first post-charging voltage Va) of the surface portion of the image bearing member that has passed through the transfer area biased by the transfer device 5 to satisfy the first set of current and/or voltage conditions (set value A) and thereafter been charged by the charger 2 and the second surface voltage (the second post-charging voltage Vb) of the surface portion of the image bearing member that has passed through the transfer area biased by the transfer device 5 to satisfy the second set of current and/or voltage conditions (set value B) different from the first set of current and/or voltage conditions (preset value A) in terms of the electric current or voltage applied to the area per unit of the image bearing member while the image bearing member 1 passing through the transfer area and thereafter been charged by the charger 2. The image forming apparatus also includes the life expectancy identification unit 9 serving as the life expectancy identification device which calculates the difference value ΔV (=|Vb−Va|), i.e., the comparison of the first post-charging voltage Va and the second post-charging voltage Vb measured by the voltage detector 8 and determines whether the life of the image bearing member 1 ends based on the comparison result.

The difference value ΔV for use in the life determination by the life expectancy identification unit 9 has a correlation with the difference in the post-charging surface voltages between the portion where no toner is attached and the portion where toner is attached and serves as an index indicating the degree of the deterioration of the image bearing member 1 related to residual image. Therefore, the end of the life of the image bearing member 1 caused by occurrence of the residual image is suitably determined.

In addition, since the image forming apparatus of the first embodiment and the second embodiment has the notification unit 11 serving as the result notification device to provide the determination result by the life expectancy identification unit 9, a user or a field engineer is able to reduce the down time of the machine by using the information about the end of the life of the image bearing member. In addition, the image forming apparatus of the second embodiment is a tandem-type structure having multiple image bearing members 1 to transfer toner images formed on these image bearing members 1 to a transfer medium and each image bearing member 1 has the voltage detector 8. The life expectancy identification unit 9 determines whether the life of each image bearing member 1 ends. Therefore, the end of the life of each image bearing member 1 can be suitably determined according to the deterioration speed of respective image bearing members 1. The image forming apparatus described in the first and the second embodiments charges the surface of the rotary image bearing member 1 by the charger 2 serving as the charging device, forms a latent electrostatic image on the surface of the charged image bearing member, develops the latent electrostatic image by the development device 4 serving as the development device to obtain a toner image, and transfers the toner image from the image bearing member to a transfer material by a transfer bias applied to the transfer area between the image bearing member and the transfer material (transfer paper as a recording medium or the intermediate transfer belt 20) by the transfer device 4 serving as the transfer device.

The image forming apparatus has the voltage detector 8 serving as the surface voltage detector. The voltage detector 8 measures the first surface voltage (the first post-charging voltage Va) of the surface portion of the image bearing member that has passed through the transfer area biased by the transfer device 5 to satisfy the first set of current and/or voltage conditions (set value A) and thereafter been charged by the charger 2 and the second surface voltage (the second post-charging voltage Vb) of the surface portion of the image bearing member that has passed through the transfer area biased by the transfer device 5 to satisfy the second set of current and/or voltage conditions (set value B) different from the first set of current and/or voltage conditions (preset value A) in terms of the electric current or voltage applied per unit of area of the image bearing member while the image bearing member 1 passing through the transfer area and thereafter been charged by the charger 2. The image forming apparatus also includes the life expectancy identification unit 9 serving as the life expectancy prediction device which calculates the difference value ΔV (=|Vb−Va|), i.e., the comparison of the first post-charging voltage Va and the second post-charging voltage Vb measured by the voltage detector 8 and predicts when the life of the image bearing member 1 ends based on the comparison result.

The difference value ΔV for use in the life expectancy prediction by the life expectancy identification unit 9 has a correlation with the difference in the post-charging surface voltages between the portion where no toner is attached and the portion where toner is attached and serves as an index indicating the degree of the deterioration of the image bearing member 1 related to residual image. Therefore, the end of the life of the image bearing member 1 caused by occurrence of the residual image is suitably predicted. The image forming apparatus described in the first and the second embodiments has the recording memory 10 serving as the over-time information memory device to store the over-time change information indicating the over-time change of the difference value ΔV until the image bearing member 1 has come to the end of its working life and the life expectancy identification unit 9 predicts when the life of the image bearing member 1 ends from the difference value ΔV and the over-time information.

Therefore, when the locus (change over time) of the difference value ΔV in the image forming apparatus indicates a peculiar change, the life can be precisely predicted. In addition, in the image forming apparatus of the variation, the life expectancy identification unit 9 identifies the standard difference value ΔVn as the reference value corresponding to when the post-charging surface voltages Va and Vb used for calculation of the difference value ΔV are measured from the over-time information. When the difference between the difference value ΔV and the identified standard difference value ΔVn is greater than the preset value f, the difference value ΔV between the first post-charging voltage Va' and the second post-charging voltage Vb' measured by the voltage detector 8 is re-calculated after a predetermined period of time β or when the image bearing member 1 rotates α rounds and the time when the life of the image bearing member 1 ends is predicted based on the difference value ΔV. Therefore, it is possible to reduce the error on the life determination and the life expectancy prediction caused by an accidental abnormal measuring. Furthermore, since the image forming apparatus described in the first and the second embodiments has the notification unit 11 as the prediction result notification device to provide notification of the life expectancy prediction result by the life expectancy identification unit 9, the user and/or the field engineer can prepare for exchanging the image bearing members by the life expectancy prediction of the image bearing member in advance, which is effective to reduce the down time of the machine. In addition, the image forming apparatus of the second embodiment is a tandem-type structure having multiple image bearing members 1 to transfer toner images formed on these image bearing members 1 to a transfer medium and each image bearing member 1 has the voltage detector 8. The life expectancy identification unit 9 predicts when the life of each image bearing member 1 ends. Therefore, the end of the life of each image bearing member 1 can be suitably predicted according to the deterioration speed of respective image bearing members 1. In particular, the image forming apparatus of the second embodiment includes the multiple image bearing members 1 include two or more mutually exchangeable image bearing members 1 and has the notification unit 11 serving as the exchange notification device prompting exchanging the image bearing member 1 having the shortest life expectancy predicted by the life expectancy identification unit 9 among the multiple image bearing members 1 with the image bearing member 1 having the longest life expectancy predicted by the life expectancy identification unit 9 among the multiple image bearing members 1 on the timing before the image bearing member 1 having the shortest life expectancy has come to an end of life.

Thereby, since the life of the two or more image bearing members can be adjusted to expire at almost the same time, the two or more image bearing members can be replaced at once with less wasting time.

In addition, in the image forming apparatus described in the first and the second embodiments, the first post-charging voltage Va and the second post-charging voltage Vb measured by the voltage detector 8 are the surface voltages at the same position on the surface of the image bearing member 1. Therefore, the measuring error caused by the difference in the measuring points on the surface of the image bearing member is small and the life determination and the life expectancy prediction can be made more precisely. In particular, in the image forming apparatus described in the first and the second embodiments, the electric current or voltage applied per unit of area of the surface of the image bearing member 1 while the image bearing member 1 passes through the transfer area in the second set of current and/or voltage conditions (set value B) is greater than the first set of current and/or voltage conditions (set value A). The voltage detector 8 measures the first post-charging voltage Va of the surface portion of the image bearing member 1. Then, without charging and discharging the image bearing member 1, the surface portion of the image bearing member 1 passes through the transfer area where a bias is applied by transfer device 5 to satisfy the second set of current and/or voltage conditions (set value B). Thereafter, the surface portion of the image bearing member 1 is biased by the charger 2 and the surface voltage of the image bearing member 1 is measured by the voltage detector 8 as the second post-charging voltage Vb.

When the first post-charging voltage Va and the second post-charging voltage Vb are continuously measured, if the electric current or voltage applied per unit of area of the surface of the image bearing member 1 while the image bearing member 1 passes through the transfer area in the first set of current and/or voltage conditions (set value A) corresponding to the first post-charging voltage Va is greater than the second set of current and/or voltage conditions (set value B) corresponding to the second post-charging voltage Vb to be measured next, the impact at the measuring of the first post-charging voltage Va is great on the measuring of the second post-charging voltage Vb. By contrast, in the image forming apparatus described in the first and the second embodiments, the second post-charging voltage Vb is not greatly affected by the first post-charging voltage Va. In addition, in the image forming apparatus described in the first and the second embodiments, preferably the first set of current and/or voltage conditions (set value A) and the second set of current and/or voltage conditions (set value B) are set such that the difference between the currents applied per unit of area of the surface of the image bearing member 1 while passing through the transfer area is set to be equal to $1.0\times10^{-5}$ [$\mu A\cdot s/mm^2$] By this setting, the difference between the post-charging surface voltages Va and Vb is clear, thereby improving the accuracy of the life expectancy prediction and the life determination. In addition, in the image forming apparatus described in the first and the second embodiments, the voltage detector 8 is arranged downstream from the charging portion where the image bearing member 1 is charged by the charger 2 and upstream from the development portion where the latent electrostatic image on the image bearing member 1 is developed by the development device 4 relative to the rotation direction of the image bearing member 1 to measure the surface voltage of the image bearing member 1.

In this case, the first post-charging voltage Va and the second post-charging voltage Vb are quickly measured. In particular, if the voltage detector 8 is arranged downstream from the irradiation portion where the image bearing member 1 is irradiated by the irradiator 3 and upstream from the development portion where the latent electrostatic image on the image bearing member 1 is developed by the development device 4 relative to the rotation direction of the image bearing member 1, a surface electrometer generally used to measure the voltage after irradiation can be used as the voltage detector 8, which is advantageous.

What is claimed is:

1. An image forming apparatus comprising:

an image bearing member to bear a latent electrostatic image;

a charger to charge a surface of the image bearing member;

an irradiator to irradiate the image bearing member with light to form the latent image;

a developing device to develop the latent electrostatic image with a developing agent comprising toner to obtain a visible image;

a transfer device to transfer the visible age to a transfer medium by a transfer bias applied to a transfer area between the image bearing member and the transfer member;

a surface voltage detector to measure a first surface voltage of a surface portion of the image bearing member charged by the charger after the image bearing member has passed through the transfer area where the transfer bias is applied by the transfer device to satisfy a first set of current and/or voltage conditions and a second surface voltage of a surface portion of the image bearing member charged by the charger after the image bearing member has passed through the transfer area where the transfer bias is applied by the transfer device to satisfy a second set of current and/or voltage conditions different from the first set of current and/or voltage conditions in absolute value of a current or a voltage applied per unit of area of the surface of the image bearing member;

a life expectancy prediction device to predict when the image bearing member comes to the end of its working life based on a comparison of the first surface voltage with the second surface voltage;

an over-time information memory device to store information on change over time in the comparison between the first the second surface until the image bearing member has come to the end of its working life, wherein the life expectancy prediction device predicts when the image bearing member comes to the end of its working life from the comparison and from the change over-time information, wherein the life expectancy prediction device:

identifies a reference value corresponding to the surface voltages for use in calculation of the comparison as measured from the change over time information;

recalculates the comparison from the first surface voltage and the second surface voltage measured by the surface voltage detector after a predetermined period of time when a difference between the comparison and the reference value is greater than a predetermined value; and predicts when the image bearing member comes to the end of its working life based on the recalculated comparison.

2. The image forming apparatus according to claim 1, further comprising a prediction result notifying device to provide notification of prediction results obtained by the life expectancy prediction device.

3. The image forming apparatus according to claim 1, further comprising multiple image bearing members, wherein the first surface voltage and the second surface voltage are measured for each of the multiple image bearing members and the life expectancy prediction device predicts when each of the multiple image bearing members has come to the end of its working life.

4. The image forming apparatus according to claim 3, wherein the multiple image bearing members comprise at least two mutually exchangeable image bearing members, wherein the image forming apparatus further comprises an exchange notification device to prompt exchanging of the image bearing member predicted to have the shortest life expectancy with the image bearing member predicted to have the longest life expectancy among the multiple image bearing members a predetermined timing before the image bearing member predicted to have the shortest life has come to the end of its working life.

5. The image forming apparatus according to claim 1, wherein the first surface voltage and the second surface voltage are measured by the surface voltage detector at the same portion of the image bearing member.

6. The image forming apparatus according to claim 1, wherein the absolute value of the current or the voltage applied per unit of area of the surface of the image bearing member while the image bearing member passes through the transfer area in the second set of current and/or voltage conditions is greater than that of the first set of current and/or voltage conditions, wherein the second surface voltage is the voltage of the surface portion of the image bearing member charged by the charger after the image bearing member has passed through the transfer area where a bias is applied by the transfer device to satisfy the second set of current and/or voltage conditions without charging and discharging the surface portion of the image bearing member that has been measured by the surface voltage detector.

7. The image forming apparatus according to claim 1, wherein a difference between the currents applied per unit of area of the surface of the image bearing member while the image bearing member passes through the transfer area in the first set of current and/or voltage conditions and the second set of current and/or voltage conditions is equal to or greater than $1.0\times10^{-5}$ ($\mu A\cdot s/mm^2$).

8. The image forming apparatus according to claim 1, wherein the surface voltage detector is arranged downstream from where the charger charges the image bearing member and upstream from where the development device develops the latent electrostatic image with the developing agent relative to a rotation direction of the image bearing member to measure the surface voltage of the image bearing member.

* * * * *

UNITED STATES PATENT AND TRADEMARK OFFICE

CERTIFICATE OF CORRECTION

PATENT NO. : 8,798,487 B2
APPLICATION NO. : 13/348062
DATED : August 5, 2014
INVENTOR(S) : Tomoharu Asano et al.

It is certified that error appears in the above-identified patent and that said Letters Patent is hereby corrected as shown below:

On the Title Page

Replace item (75) of the patent with the following:

Inventors: Tomoharu Asano, Shizuoka (JP)
Takaaki Ikegami, Shizuoka (JP)
Michio Kimura, Shizuoka (JP)

Signed and Sealed this
Twenty-fifth Day of November, 2014

Michelle K. Lee

Michelle K. Lee
*Deputy Director of the United States Patent and Trademark Office*